US005772070A

United States Patent [19]

Hayes et al.

[11] Patent Number: 5,772,070

[45] Date of Patent: Jun. 30, 1998

[54] HIGH-STRENGTH GUSSETED LID FOR A FOOD CONTAINER

[75] Inventors: Thomas J. Hayes, Wauconda; Michael J. A. Sagan, Batavia; James N. Gomoll, Chicago, all of Ill.

[73] Assignee: Tenneco Packaging, Evanston, Ill.

[21] Appl. No.: 718,862

[22] Filed: Sep. 24, 1996

[51] Int. Cl.[6] ..... B65D 41/16

[52] U.S. Cl. ..... 220/781; 220/782; 220/793

[58] Field of Search ..... 220/781, 782, 220/792, 793, 794, 380

[56] References Cited

U.S. PATENT DOCUMENTS

| | | | |
|---|---|---|---|
| 1,249,096 | 12/1917 | Hulme | 220/792 |
| 3,460,711 | 8/1969 | Al-Roy | 220/781 |
| 3,632,016 | 1/1972 | Bozek | 220/380 X |
| 4,262,815 | 4/1981 | Klein | 220/380 X |
| 5,460,286 | 10/1995 | Rush et al. | 220/781 X |

OTHER PUBLICATIONS

Brochure "Micro Fine" by Central Fine Pack of Fort Wayne, Indiana; Jan., 1993.

Pamphlet entitled "Classic Carry–Out Containers" by PCA Specialty Packaging Group of Northbrook, IL; Mar., 1995.

Pamphlet entitled "Classic Carry–Out Meal Delivery System—An Extraordinary New Way to Carry Meals Out" by PCA Specialty Packaging Group of Northbrook, IL, Oct., 1994.

Pamphlet entitled "Classic Carry–Out Containers—Where White Cloth Dining Meets Carry–Out Convenience" by PCA Specialty Packaging Group of Northbrook, IL; Mar., 1995.

Tenneco Packaging Specialty Products Catalog, Summer of 1996.

Photographs of Central Fine Pack Container, Central Fine Pack, Inc. of Fort Wayne, Indiana No date.

*Primary Examiner*—Jes F. Pascua

*Attorney, Agent, or Firm*—Arnold, White & Durkee

[57] ABSTRACT

A lid for a plastic food container includes a continuous body portion and a continuous rim encompassing and projecting laterally outwardly from the body portion. The body portion includes a peripheral region, a transition region, and a central region. The peripheral region encompasses the transition region and the central region, extends between the continuous rim and the transition region, and slopes downward at a first acute angle from the continuous rim to the transition region. The transition region encompasses the central region, extends between the peripheral region and the central region, and includes first and second transition portions. The first transition portion intersects the peripheral region and slopes upward at a second acute angle from the peripheral region to the second transition portion. The second transition portion intersects the central region and slopes upward at a third acute angle from the first transition portion to the central region. The second acute angle is greater than the third acute angle. The transition region includes a plurality of spaced gussets interrupting the first and second transition portions.

12 Claims, 6 Drawing Sheets

HIGH-STRENGTH GUSSETED LID FOR A FOOD CONTAINER

FIELD OF THE INVENTION

The present invention relates generally to plastic food containers and, more particularly, relates to a food container having a gusseted lid with improved beam strength, improved top load compression strength, and improved leak resistance.

BACKGROUND OF THE INVENTION

In many consumer packaging applications, plastic containers are stacked on top of one another in order to improve the efficiency by which the containers are shipped and handled. If each plastic container includes a lid and a base, cases/boxes holding the plastic containers may be shipped from the manufacturer or distributor to a retailer with the lids in one stack and the bases in another stack. The retailer may subsequently load the containers with a food product and stack the filled containers on top of one another to facilitate transportation and handling thereof. A drawback of many existing containers is that the lids thereof can crack or tear in response to abuses undergone during shipping and handling.

When the containers are used to hold food products containing food juices, another drawback of such containers is that vapor from the food juices can condense on the inner surface of the lid. This, in turn, can cause leakage of the condensed vapor from the periphery of the container and spillage of the condensed vapor once the vapor-laden lid is removed to open the container. By way of explanation, a container typically includes a lid having a first peripheral rim and a base having a second peripheral rim. Further, the region of the lid adjacent to the first peripheral rim may be flat and horizontal in orientation when the container is laid on a horizontal surface. Vapor from the food juices has a tendency to condense on this flat horizontal region of the lid. The condensed vapor can migrate out of the container through small gaps between the first and second peripheral rims. Also, the condensed vapor can remain adhered to the lid until the lid is detached from the base, at which time the condensed vapor can undesirably run off the lid and create a mess.

A need therefore exists for a lid for a plastic food container that substantially overcomes one or more of the aforementioned shortcomings associated with many existing containers.

SUMMARY OF THE INVENTION

A lid for a plastic food container includes a continuous body portion and a continuous rim encompassing and projecting laterally outwardly from the body portion. The body portion includes a peripheral region, a transition region, and a central region. The peripheral region encompasses the transition region and the central region, extends between the continuous rim and the transition region, and slopes downward at a first acute angle from the continuous rim to the transition region. The transition region encompasses the central region, extends between the peripheral region and the central region, and includes first and second transition portions. The first transition portion intersects the peripheral region and slopes upward at a second acute angle (relative to the horizontal) from the peripheral region to the second transition portion. The second transition portion intersects the central region and slopes upward at a third acute angle (relative to the horizontal) from the first transition portion to the central region. The second acute angle is greater than the third acute angle.

The transition region includes a plurality of spaced gussets interrupting the first and second transition portions. In one embodiment, each gusset is defined by a generally horizontal bottom wall, a generally vertical first side wall, and a pair of opposing and generally vertical second side walls. The bottom wall extends between the peripheral region and the first side wall. The first side wall extends upwardly from the bottom wall and extends between the bottom wall and the central region. Further, the first side wall extends between the pair of opposing second side walls. The second side walls extend upwardly from the bottom wall and intersect the first and second transition portions. Also, the second side walls slope away from each other as they extend upwardly from the bottom wall.

BRIEF DESCRIPTION OF THE DRAWINGS

Other objects and advantages of the invention will become apparent upon reading the following detailed description and upon reference to the drawings in which.

Figure 1:
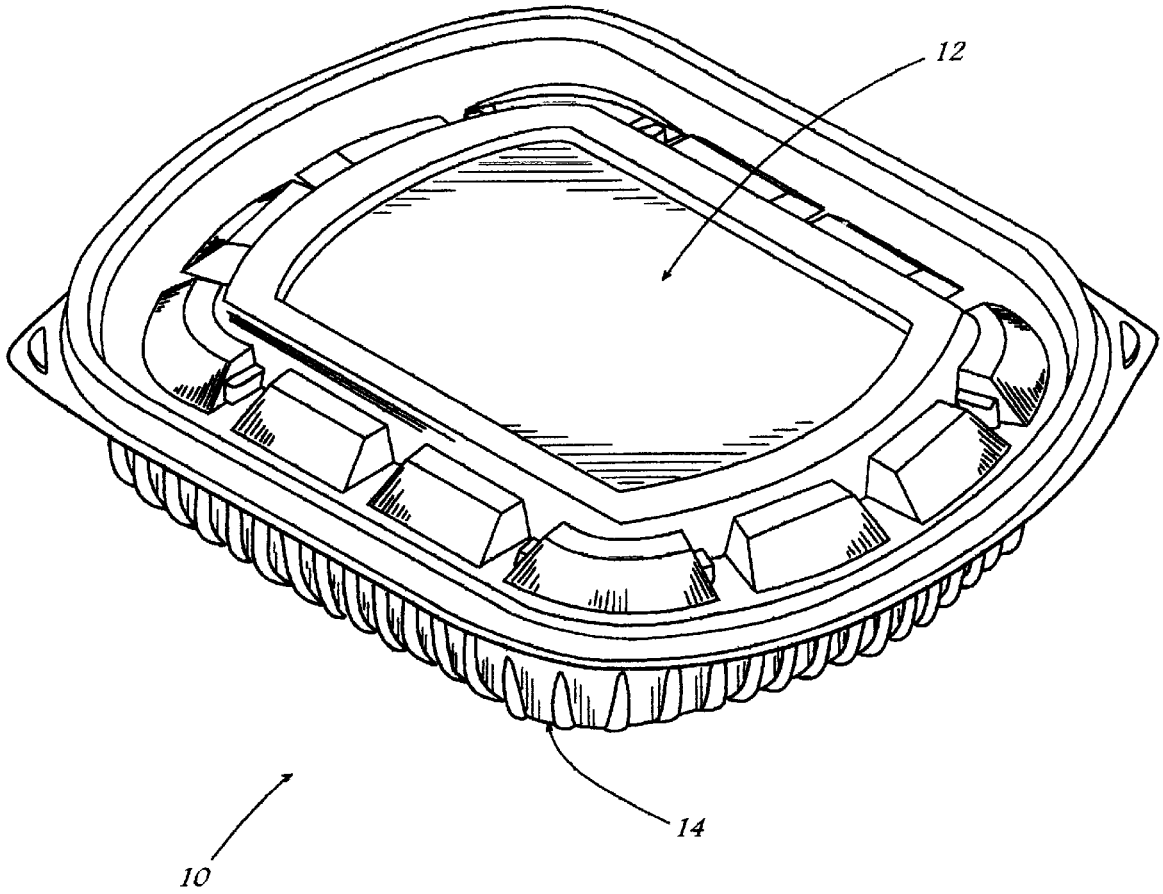
FIG. 1 is an isometric view of a plastic food container embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Turning now to the drawings, FIG. 1 illustrates a plastic food container 10 embodying the present invention. The plastic food container 10 includes a lid 12 and a base 14.

Figure 2:
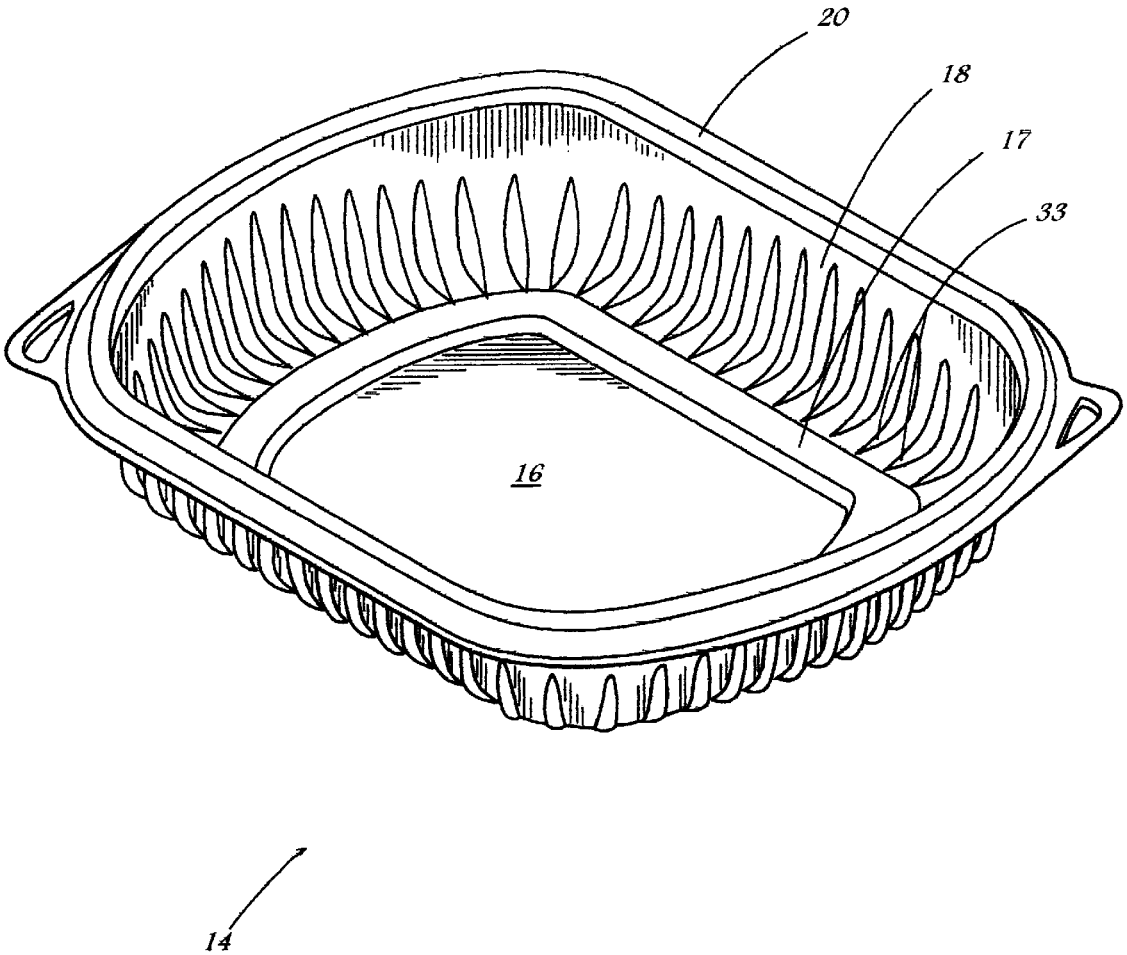
FIG. 2 is an isometric view of a base of the food container in FIG. 1.

Referring to FIG. 2, the base 14 includes a bottom wall 16, a continuous side wall 18, and a continuous rim 20. To facilitate stacking of multiple containers, the bottom wall 16 forms an indented peripheral member 17 designed to engage with a raised peripheral member (akin to the member 31 in FIG. 3) on the lid of an identical container stacked beneath the container 10. The continuous side wall 18 encompasses the bottom wall 16 and extends upwardly and outwardly from the bottom wall 16. The side wall 18 preferably includes some type of ribbing structure to enhance the top load compression strength of the container 10. The continuous rim 20 encompasses and projecting laterally outwardly from the side wall 18. The rim 20 is designed to releasably engage with a continuous rim on the lid 12 so that the lid 12 can be connected to the base 14.

Figure 3:
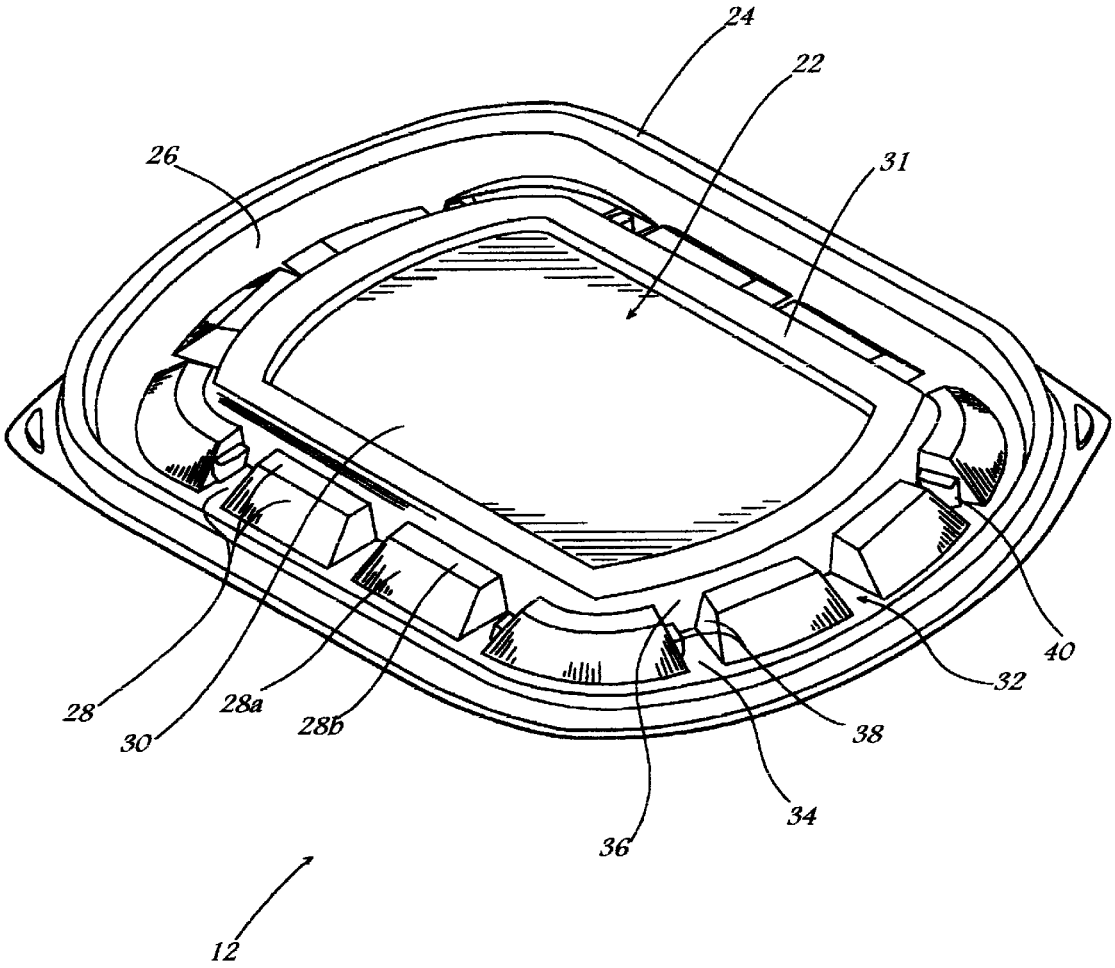
FIG. 3 is an isometric view of a lid of the food container in FIG. 1.
Figure 4:
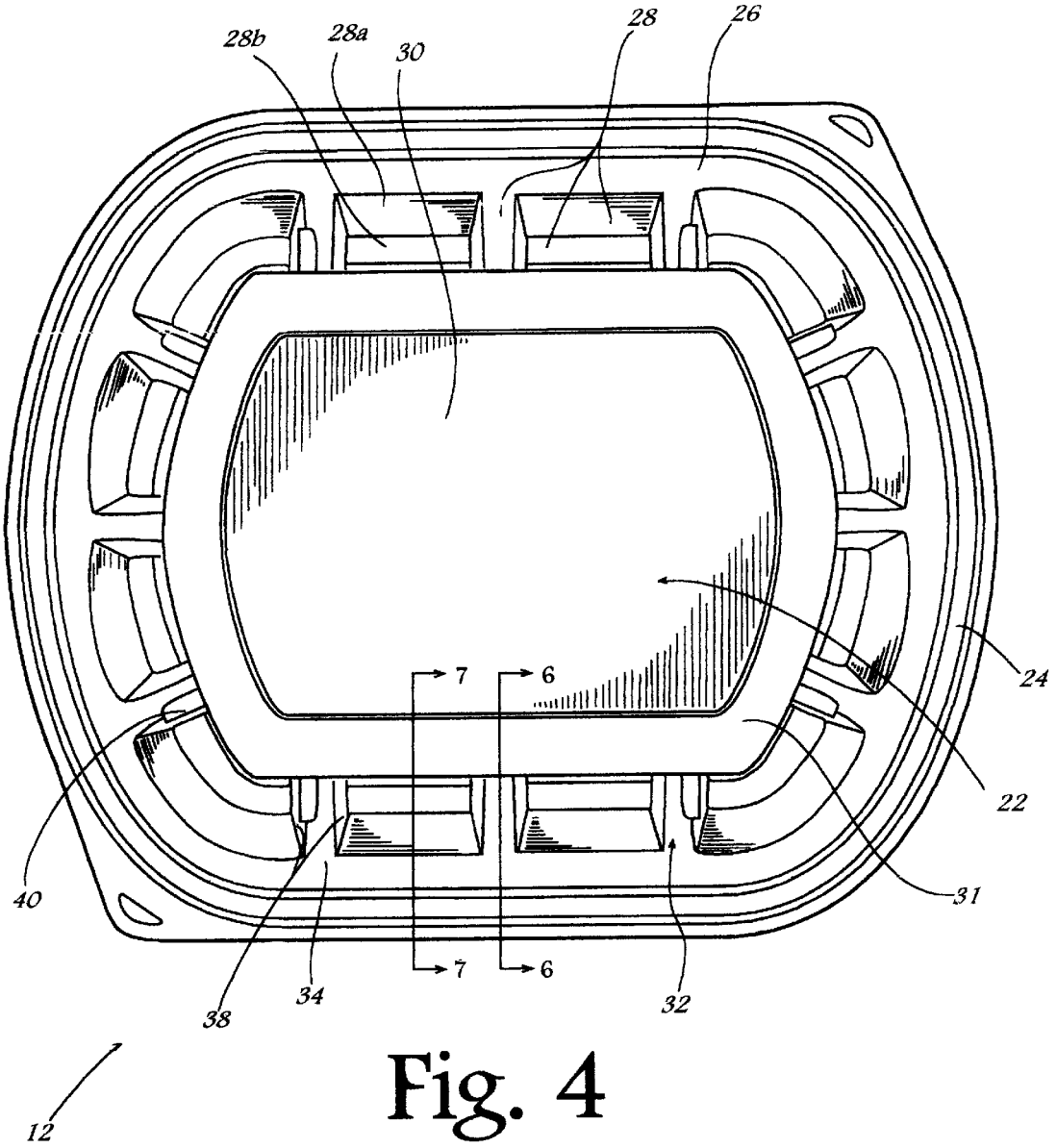
FIG. 4 is a top plan view of the lid of the food container in FIG. 1.
Figure 5:
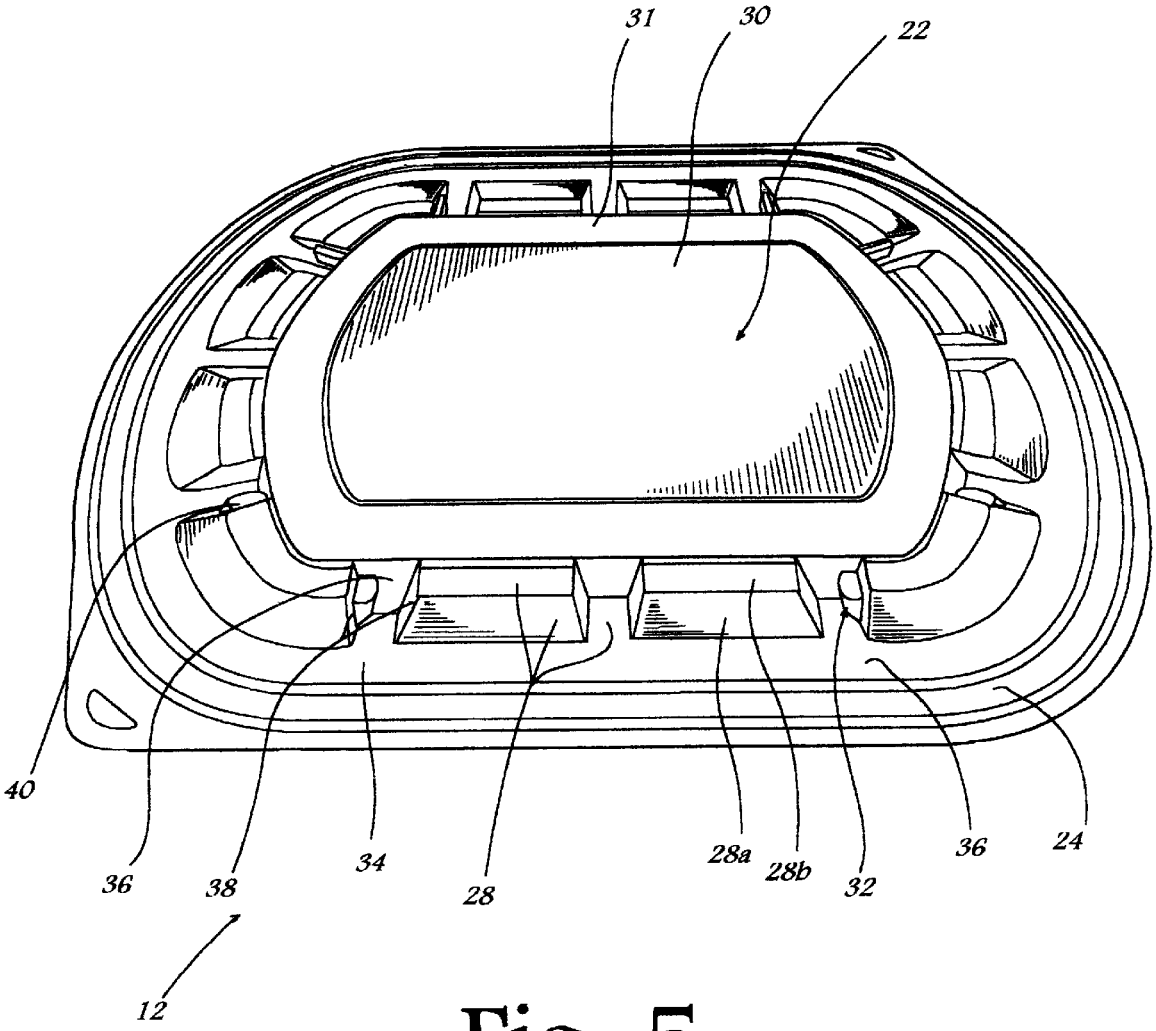
FIG. 5 is a front perspective view of the lid of the food container in FIG. 1.

Referring to FIGS. 3, 4, and 5, the lid 12 includes a continuous body portion 22 and a continuous rim 24 encompassing and projecting laterally outwardly from the body portion 22. The body portion 22 includes a peripheral region 26, a transition region 28, and a central region 30. The peripheral region 26 encompasses the transition region 28 and the central region 30 and extends between the continuous rim 24 and the transition region 28. The transition region 28 encompasses the central region 30, extends between the peripheral region 26 and the central region 30, and includes first and second transition portions 28*a* and 28*b*. To facilitate stacking of multiple containers, the central region 30 includes a raised peripheral member 31 designed to engage with an indented peripheral member (akin to the member 17 in FIG. 2) on the base of an identical container stacked on top of the container 10.

Figure 6:
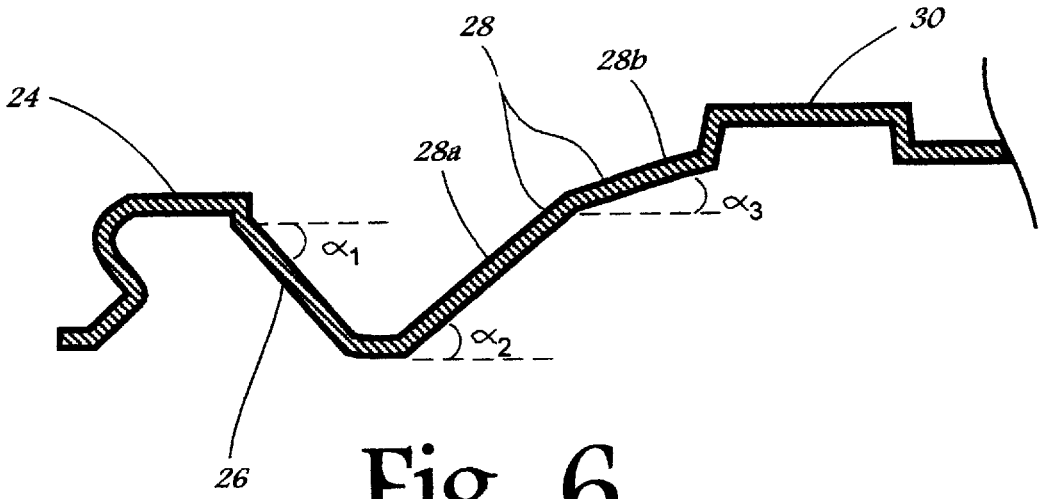
FIG. 6 is a sectional view taken generally through line 6—6 in FIG. 4.

As best shown in FIG. 6, the peripheral region 26 slopes downward at an acute angle $\alpha_1$ (relative to the horizontal) from the continuous rim 24 to the transition region 28. To facilitate thermoforming of the lid 12, a juncture joining the transition region 28 and the peripheral region 26 is preferably radiused. The first transition portion 28*a* intersects the peripheral region 26 and slopes upward at an acute angle $\alpha_2$ (relative to the horizontal) from the peripheral region 26 to the second transition portion 28*b*. The second transition portion 28*b* intersects the central region 30 and slopes upward at an acute angle $\alpha_3$ (relative to the horizontal) from the first transition portion 28*a* to the central region 30. The acute angle $\alpha_2$ is greater than the acute angle $\alpha_3$. In one embodiment, the acute angle $\alpha_1$ ranges from approximately 30 to 45 degrees, the acute angle $\alpha_2$ ranges from approximately 25 to 40 degrees, and the acute angle $\alpha_3$ ranges from approximately 5 to 10 degrees.

The second transition portion 28*b* preferably slopes upward at the acute angle $\alpha_3$ in order to facilitate stacking of another container on top of the container 10. When another container is stacked on top of the container 10, tear-drop-shaped peripheral ribs (akin to the bottom ribs 33 in FIG. 2) on the base of the upper container sit on the second transition portion 28*b*. The slope of the second transition portion 28*b* matches the slope of bottom ribs so that the upper container stably stacks on top of the container 10.

Figure 7:
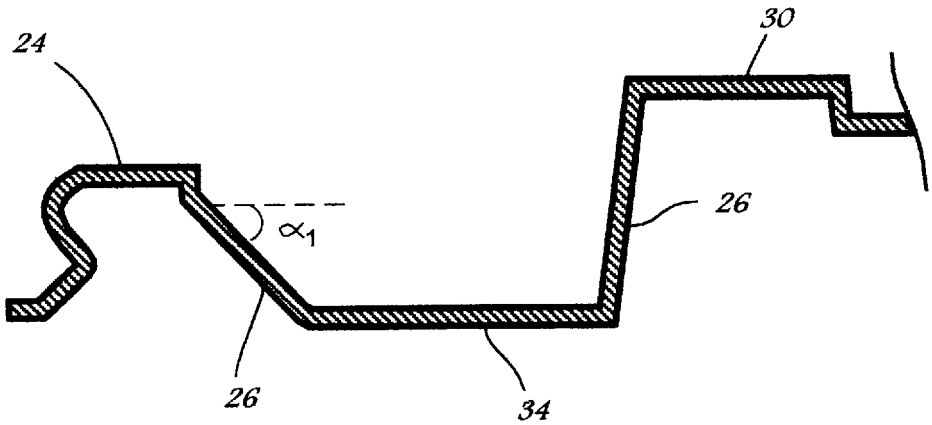
FIG. 7 is a sectional view taken generally through line 7—7 in FIG. 4.

The transition region 28 includes a plurality of spaced gussets 32 interrupting the first and second transition portions 28*a* and 28*b*. In one embodiment, each gusset 32 is defined by a generally horizontal bottom wall 34, a generally vertical first side wall 36, and a pair of opposing and generally vertical second side walls 38. The bottom wall 34 extends between the peripheral region 26 and the first side wall 36 (see FIG. 7). The first side wall 36 extends upwardly from the bottom wall 34 and extends between the bottom wall 34 and the central region 30 (see FIG. 7). Further, the first side wall 36 extends between the pair of opposing second side walls 38. The second side walls 38 extend upwardly from the bottom wall 34 and intersect the first and second transition portions 28*a* and 28*b*. Due to their intersection with the sloping transition portions 28*a* and 28*b*, the second side walls 38 are each generally trapezoidal in shape. As best shown in FIG. 5, the second side walls 38 slope gently away from each other as they extend upwardly from the bottom wall 34 in order to provide for better distribution of plastic material when the lid 12 is thermoformed.

To ship multiple empty containers 10, the lids 12 and the bases 14 of those containers are typically packaged separately from each other. The lids 12 are stacked and placed into one package (e.g., plastic bag), while the bases 14 are stacked and placed into another package. Once the lids 12 and the bases 14 reach their destination and it is desired to load food into individual containers, the lids 12 and the bases 14 must each be unstacked and then combined to form the individual containers. To facilitate such unstacking of the lids 12, the lid 12 includes a plurality of denesting lugs 40 disposed in the respective gussets 32. The denesting lug 40 of a particular gusset 32 projects inwardly from one of the second side walls 38 toward the other of the second side walls 38. The lug 40 is located at a juncture of the bottom wall 34, the first side wall 36, and the one of the second side walls 38. Also, the lug 40 is preferably shorter than the maximum height of the one of the second side walls 38.

An important advantage of the lid 12 is that it exhibits improved beam strength and top load compression strength relative to the lids of prior art containers. The improved beam strength and top load compression strength is largely due to the unique structure of the gussets 32 and the sloping walls of the peripheral region 26 and the first and second transition portions 28*a* and 28*b*. The structural integrity of the lid 12 allows the lid 12 to withstand substantial abuses undergone during shipping and handling, such as when multiple containers are filled and stacked on top of one another.

Another important advantage of the lid 12 is that it exhibits improved leak resistance. When the container 10 is used to hold food products containing food juices, the unique structure of the lid 12 minimizes condensation of vapor from the food juices on the inner surface of the lid 12. In particular, the sloping walls of the peripheral region 26 and the first and second transition portions 28*a* and 28*b* promote rapid runoff of the vapor back into the base 14. Such runoff into the base 14 prevents leakage of the vapor from the periphery of the container 10. Also, since the vapor does not have a tendency to remain adhered to the lid 12 for a long period of time, removal of the lid 12 from the base 14 will not cause spillage of any vapor.

The plastic food container 10 is preferably manufactured using conventional thermoforming techniques. The lid 12 is preferably composed of oriented polystyrene (OPS), polyethylene terephthalate (PET), polyvinyl chloride (PVC), or a combination thereof. The base 14 is preferably composed of polypropylene (PP). Those of ordinary skill in the art will recognize that other polymers or combinations of polymers may be used to thermoform the lid 12 and base 14.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A lid for a plastic food container, comprising:

a continuous body portion; and a continuation rim encompassing and projecting laterally outwardly from said body portion;

said body portion including a peripheral region, a transition region, and a central region, said peripheral region encompassing said transition region and said central region, said peripheral region extending between said continuous rim and said transition region, said peripheral region sloping downward at a first acute angle from said continuous rim toward said transition region, said transition region encompassing said central region, said transition region extending between said peripheral region and said central region, said transition region including first and second transition portions, said first transition portion intersecting said peripheral region and sloping upward at a second acute angle from said peripheral region to said second transition portion, said second transition portion intersecting said central region and said first transition portion, said second transition portion sloping upward at third acute angle from said first transition portion to said central region, said first transition portion further having a length in cross-section equal to or greater than a length in cross-section of said second transition portion, said second acute angle being greater than said third acute angle.

2. A lid for a plastic food container, comprising:

a continuous body portion, and a continuous rim encompassing and projecting laterally outwardly from said body portion;

said body portion including a peripheral region, a transition region, and a central region, said peripheral region encompassing said transition region and said central region, said peripheral region extending between said continuous rim and said transition region, said peripheral region sloping downward at a first acute angle from said continuous rim toward said transition region, said transition region encompassing said central region, said transition region extending between said peripheral region and said central region, said transition region including first and second transition portions, said first transition portion intersecting said peripheral region and sloping upward at a second acute angle from said peripheral region to said second transition portion, said second transition portion intersecting said central region and sloping upward at a third acute angle from said first transition portion to said central region, wherein said first acute angle ranges from approximately 30 to 45 degrees, said second acute angle ranges from approximately 25 to 40 degrees, and said third acute angle ranges from approximately 5 to 10 degrees.

3. A lid for a plastic food container, comprising:

a continuous body portion; and a continuous rim encompassing and projecting laterally outwardly from said body portion;

said body portion including a peripheral region, a transition region, and a central region, said peripheral region encompassing said transition region and said central region, said peripheral region extending between said continuous rim and said transition region, said peripheral region sloping downward at a first acute angle from said continuous rim toward said transition region, said transition region encompassing said central region, said transition region extending between said peripheral region and said central region, said transition region including first and second transition portions, said first transition portion intersecting said peripheral region and sloping upward at a second acute angle from said peripheral region to said second transition portion, said second transition portion intersecting said central region and said first transition portion, said second transition portion sloping upward at a third acute angle from said first transition portion to said central region, said first transition portion further having a length in cross-section equal to or greater than a length in cross-section of said second transition portion, said transition region including a plurality of spaced gussets interrupting said first and second transition portions.

4. A lid for a plastic food container, comprising:

a continuous body portion, and a continuous rim encompassing and projecting laterally outwardly from said body portion;

said body portion including a peripheral region, a transition region, and a central region, said peripheral region encompassing said transition region and said central region, said peripheral region extending between said continuous rim and said transition region, said peripheral region sloping downward at a first acute angle from said continuous rim toward said transition region, said transition region encompassing said central region, said transition region extending between said peripheral region and said central region, said transition region including first and second transition portions, said first transition portion intersecting said peripheral region and sloping upward at a second acute angle from said peripheral region to said second transition portion, said second transition portion intersecting said central region and sloping upward at a third acute angle from said first transition portion to said central region, wherein said transition region includes a plurality of spaced gussets interrupting said first and second transition portions, each of said gussets being defined by a generally horizontal bottom wall, a generally vertical first side wall, and a pair of opposing and generally vertical second side walls, said bottom wall extending between said peripheral region and said first side wall, said first side wall extending upwardly from said bottom wall and extending between said bottom wall and said central region, said first side wall extending between said pair of opposing second side walls, said second side walls extending upwardly from said bottom wall and intersecting said first and second transition portions.

5. The lid of claim 4, wherein said second side walls slope away from each other as said second side walls extend upwardly from said bottom wall.

6. The lid of claim 4, wherein each of said second side side walls is generally trapezoidal in shape.

7. A lid for a plastic food container, comprising:

a continuous body portion; and a continuous rim encompassing and projecting laterally outwardly from said body portion;

said body portion including a peripheral region, a transition region, and a central region, said peripheral region encompassing said transition region and said central region, said transition region encompassing said central region, said transition region including a plurality of spaced gussets, each of said gussets being defined by a generally horizontal bottom wall, a generally vertical first side wall, and a pair of opposing and generally vertical second side walls, each of said second side walls being generally trapezoidal in shape.

8. The lid of claim 1, wherein said bottom wall extends between said peripheral region and said first side wall, said first side wall extends upwardly from said bottom wall and extends between said bottom wall and said central region, said first side wall extends between said pair of opposing second side walls, and said second side walls extends upwardly from said bottom wall and intersects said first and second transition portions.

9. The lid of claim 1, wherein said second side walls slope away from each other as said second side walls extend upwardly from said bottom wall.

10. The lid of claim 1, wherein said transition region includes first and second transition portions, said first transition portion intersecting said peripheral region and sloping upward from said peripheral region to said second transition portion, said second transition portion intersecting said central region and sloping upward from said first transition portion to said central region, and wherein said spaced gussets interrupt said first and second transition portions.

11. A lid for a plastic food container, comprising:

a continuous body portion; and a continuous rim encompassing and projecting laterally outwardly from said body portion;

said body portion including a peripheral region, a transition region, and a central region, said peripheral region encompassing said transition region and said central region, said peripheral region extending between said continuous rim and said transition region, said peripheral region sloping inwardly towards a center of said central region and downward at a first acute angle from said continuous rim toward said transition region, said transition region encompassing said central region, said transition region extending between said peripheral region and said central region, said transition region including first and second transition portions, said first transition portion intersecting said peripheral region and sloping upward at a second acute angle from said peripheral region to said second transition portion, said second transition portion intersecting said central region and sloping upward at a third acute angle from said first transition portion to said central region, said first transition portion further having a length in cross-section at least equal to a length in cross-section of said second transition portion, said second acute angle being greater than said third acute angle, said first acute angle ranging from approximately 30 to 45 degrees, said second acute angle ranging from approximately 25 to 40 degrees, and said third acute angle ranging from approximately 5 to 10 degrees.

12. A lid for a plastic food container, comprising:

a continuous body portion; and a continuous rim encompassing and projecting laterally outwardly from said body portion;

said body portion including a peripheral region, a transition region, and a central region, said peripheral region encompassing said transition region and said central region, said peripheral region extending between said continuous rim and said transition region, said peripheral region sloping inwardly towards a center of said central region and downward at a first acute angle from said continuous rim toward said transition region, said transition region encompassing said central region, said transition region extending between said peripheral region and said central region, said transition region including first and second transition portions, said first transition portion intersecting said peripheral region and sloping upward at a second acute angle from said peripheral region to said second transition portion, said second transition portion intersecting said central region and sloping upward at a third acute angle from said first transition portion to said central region, said first transition portion further having a length in cross-section at least equal to a length in cross-section of said second transition portion, said transition region including a plurality of spaced gussets interrupting said first and second transition portions.

* * * * *